US008317041B2

(12) United States Patent
Porma et al.

(10) Patent No.: US 8,317,041 B2
(45) Date of Patent: Nov. 27, 2012

(54) METHOD FOR CONTROLLING A CRANE

(75) Inventors: Mikko Porma, Vantaa (FI); Kimmo Hytönen, Hyvinkää (FI)

(73) Assignee: KCI Konecranes PLC, Hyvinkaa (FI)

( * ) Notice: Subject to any disclaimer, the term of this patent is extended or adjusted under 35 U.S.C. 154(b) by 998 days.

(21) Appl. No.: 10/564,522

(22) PCT Filed: Jul. 16, 2004

(86) PCT No.: PCT/FI2004/000458

§ 371 (c)(1),
(2), (4) Date: Jun. 22, 2006

(87) PCT Pub. No.: WO2005/007554

PCT Pub. Date: Jan. 27, 2005

(65) Prior Publication Data

US 2007/0023378 A1 Feb. 1, 2007

(30) Foreign Application Priority Data

Jul. 17, 2003 (FI) ..... 20031087

(51) Int. Cl.
*B66C 13/06* (2006.01)

(52) U.S. Cl. ..... 212/275

(58) Field of Classification Search ..... 212/275
See application file for complete search history.

(56) References Cited

U.S. PATENT DOCUMENTS 5,529,193 A * 6/1996 Hytonen ..... 212/275
6,102,221 A 8/2000 Habisohn

FOREIGN PATENT DOCUMENTS

DE 2751823 A1 6/1978
JP 59117474 7/1984
WO WO-92/18416 A1 10/1992
WO WO 92/18416 A1 10/1992

* cited by examiner

*Primary Examiner* — Emmanuel M Marcelo
(74) *Attorney, Agent, or Firm* — Muncy, Geissler, Olds & Lowe, PLLC

(57) ABSTRACT

The invention relates to a method for controlling a crane, the method comprising comparing velocity requests ($V_{ref}$) given by a crane control system with a previous velocity request and, if the velocity request is changed, forming and storing an acceleration sequence for the corresponding velocity change, summing the velocity changes defined by the stored acceleration sequences at a particular time and adding the obtained sum (dV) to the previous velocity request to achieve a new velocity request ($V_{ref2}$), which is set as a new control and velocity request for the crane drives (11, 12), and performing some of the velocity changes defined by the summed acceleration sequences at the definition time of each selected sequence on each program round, i.e. control step, and performing the rest of them as delayed in such a manner that the stored sequence parts to be performed as delayed are read and summed on a plurality of program rounds.

5 Claims, 2 Drawing Sheets

METHOD FOR CONTROLLING A CRANE

BACKGROUND OF THE INVENTION

The invention relates to a method for controlling a crane, the method comprising giving velocity requests as control sequences from a crane control system to crane drives and reading and storing the velocity requests in a control system, whereby each velocity request is compared with the previous velocity request and, if the velocity request is changed, an acceleration sequence for the corresponding velocity change is formed and stored, after which, irrespective of whether the velocity request has changed, summing the velocity changes defined by the stored acceleration sequences at a particular time and adding the obtained sum to the previous velocity request to achieve a new velocity request, which is set as a new control and velocity request for the crane drives, and performing some of the velocity changes defined by the summed acceleration sequences at the definition time of each selected sequence on each program round, i.e. control step (sample interval) and performing the rest of them as delayed.

The above method is disclosed in Finnish Patent 89155. By using this method it is possible to efficiently prevent the undesired swinging of load fastened to the crane, disturbing the use and operability of the crane when the crane is controlled and the load is transferred. The method improves the properties of a crane control system by summing, in a particular manner, different control sequences eliminating the swinging occurring after load acceleration. By using this method, the end velocities forming the target of acceleration can be randomly changed at any time, also during the actual velocity change sequences, and a new, desired end velocity is achieved without undesired swinging of the load.

According to prior art, a control preventing the load swinging typically comprises two acceleration sequences, the time difference of which is half of the oscillation time of the load. Another, easily definable control consists of three acceleration sequences with the same magnitude but varying directions, the first sequence being positive, the second negative and the third positive, whereby the time between the sequences equals to one sixth of the oscillation time of the load. In the method of Finnish Patent 89155, these control sequences preventing the load swinging can differ from each other and an unlimited amount of them can be defined. It is essential that when the accelerations defined by them are summed up, a control preventing the swinging is achieved. When the sum of the accelerations is selected in such a manner that it implements the desired velocity change, a control is achieved, wherein the desired end velocity of the crane is produced without swinging of the load.

U.S. Pat. No. 5,526,946 discloses an application of the same subject, whereby, whenever the reference value of velocity changes, a half of it is performed and the other half is stored in a table, where the performance of it is delayed by a half of the oscillation time of the load. This is a preferred embodiment of the method according to Finnish Patent 89155 and used in computer calculation.

When a new control preventing swinging is calculated on each program round, i.e. control step, and, on the other hand, the controls stored in the tables are updated and the control formed by them is also calculated on each program round, there will be calculatory problems. When the calculation is accelerated, the size of the tables becomes bigger and more calculations must be made on each program round, because the size of the table is defined on the basis of the relation between oscillation time and the control step. When the control step is decreased, for instance, from 100 milliseconds to 10 milliseconds, the number of calculations will be decupled. As the pendulum arm of the load becomes longer, the number of elements to be stored will grow further. To decrease the control step is reasonable, because it shortens the reaction delay and thus provides the crane driver with a better control of the driving.

Electric drives, which are used for controlling the velocity of traversing motors of a crane, are controlled by a microprocessor and the duration of their programs is short, 2 to 5 milliseconds. As to the technical implementation, it is also preferable to calculate the velocity request preventing the swinging in the same time plane. As can be seen from the above, as the control step becomes smaller, the amount of memory capacity and the number of calculations increase rapidly. In some cases, this makes it more difficult to calculate the preventing of the swinging when, for instance, electric drives controlling the rotational speed of traversing motors are used.

SUMMARY OF THE INVENTION

It is an object of the invention to eliminate these drawbacks. The object is achieved by a method of the invention, characterized by reading and summing the stored sequence parts to be performed as delayed on a plurality of program rounds, preferably at a time interval which is many times longer than said control step.

Although control calculation by using a short control step is advantageous for the response time of the system, the swinging of the load is so slow that in practice, e.g. with a pendulum arm of 4 meters, a swinging control which is accurate enough is achieved by using a control step of about 100 milliseconds. The method of the invention employs a method for calculating a control preventing the load from swinging by combining controls preventing the swinging in a manner described in Finnish Patent 89155, but in such a manner that the first part of the sequence corresponding to the measured change of the driver's velocity request is always performed immediately, e.g. at each sample interval of 5 milliseconds, but the tabulated sequence parts to be performed as delayed are calculated at a longer time interval, e.g. at intervals of 100 milliseconds.

The method of the invention considerably reduces the number of calculations unnecessary for the damping of load swinging, and, at the same time, crane control is improved considerably. In this way, problems relating to the calculating rate and memory capacity of the calculating unit of the control system can be avoided.

LIST OF FIGURES

The invention will now be described in greater detail with reference to the attached drawings, in which FIG. 1 schematically shows a crane;

DETAILED DESCRIPTION OF THE INVENTION

The method of the invention is illustrated in connection with a simple overhead crane 1 of FIG. 1, even though any other crane, where the load to be lifted can oscillate, is also possible.

Figure 1:
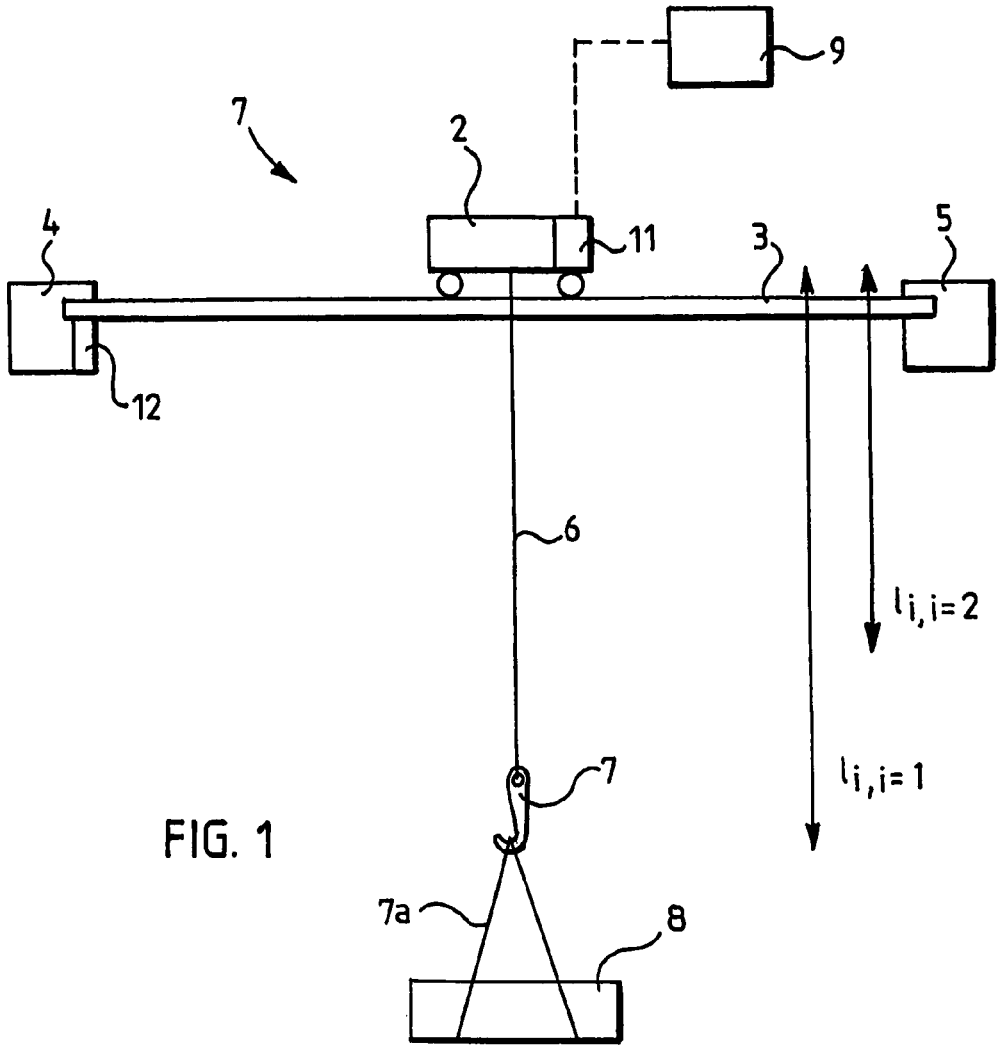

A trolley 2 of the overhead crane 1 according to FIG. 1 is arranged to be moved along a bridge beam 3, which can be moved along end beams 4 and 5 arranged at the ends of the bridge beam 3 perpendicularly to the movement of the trolley 2. A lifting rope 6, at the end of which there is a lifting element 7, in this case a lifting hook, hangs from the trolley 2. A load 8 to be lifted is fastened by means of lifting belts 7*a* to the lifting hook 7. Each different lifting height $I_i$ (i=1, 2, . . . ) has a characteristic oscillation time T of the lifting height $I_i$, whereby the oscillation time of the load 8 is obtained by the formula:

$$T=2\pi(I_i/g)^{1/2}, \text{where } g=\text{acceleration of gravity.}$$

Figure 2:
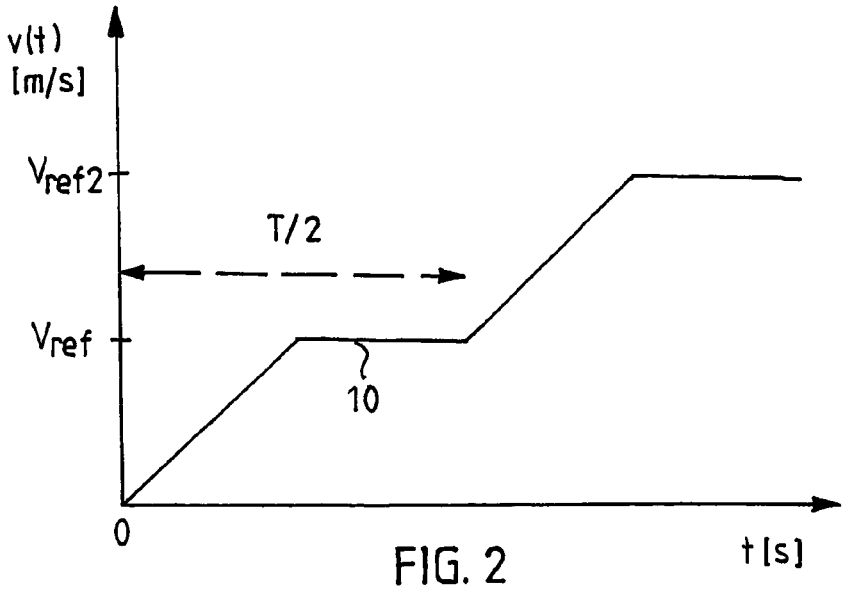
FIG. 2 shows a velocity sequence acting as a control sequence.

The crane 1 is controlled with a crane control system 9 by means of different control sequences 10, one simple example of which is shown in FIG. 2. A control sequence 10 of FIG. 2 is a velocity vector v(t), which is shown as a function of time t. The control sequence 10 is directed to control a drive 11 of the trolley 2 or a drive 12 of the bridge beam 3 supporting the trolley 2. Drives are typically electric motor drives with frequency converters.

Figure 3:
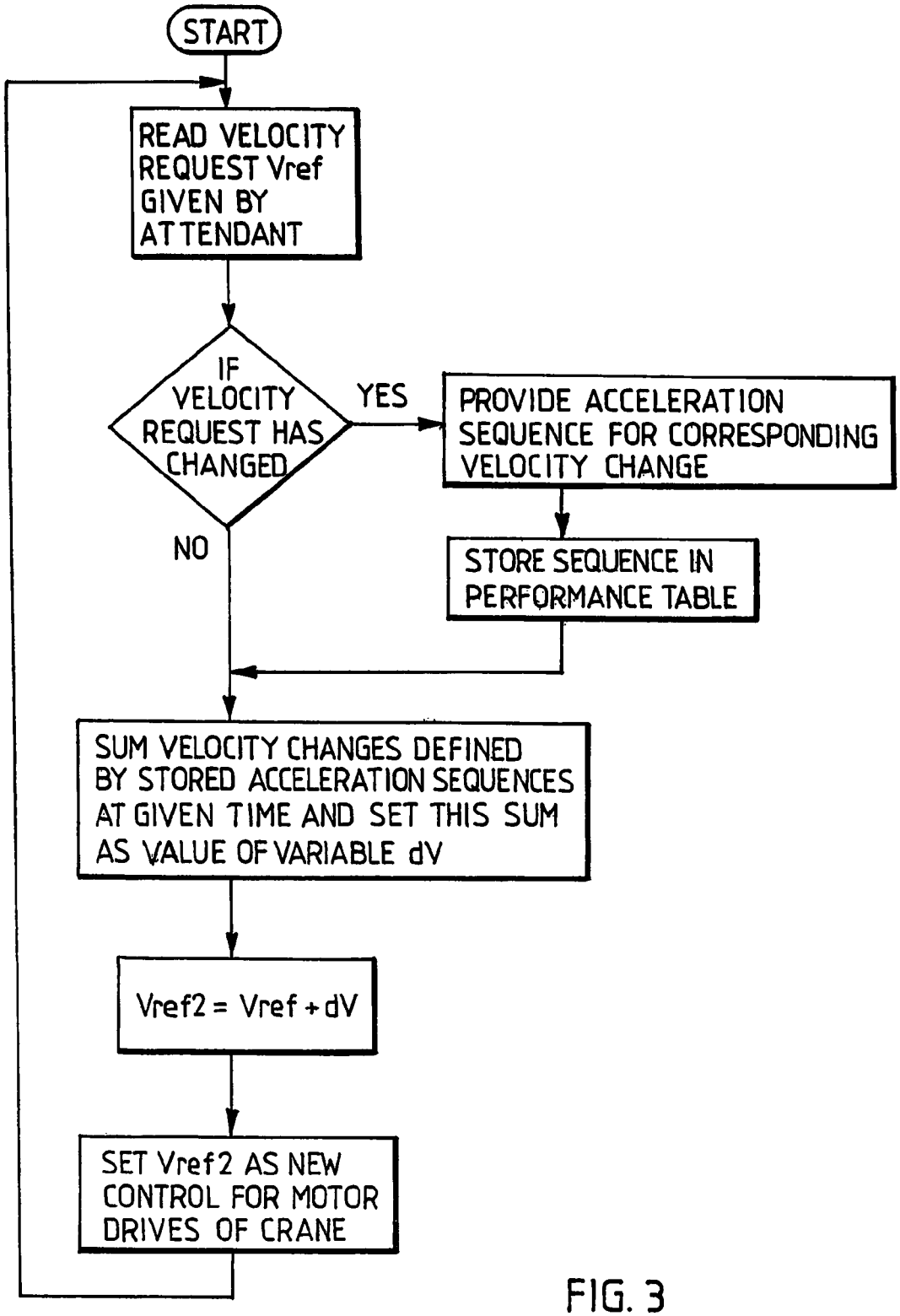
FIG. 3 shows a flow chart of a crane control.

FIG. 3 shows a flow chart illustrating a method for controlling a crane and forming a basis for the invention. The user of the crane 1 gives, from the control system 9, velocity requests $V_{ref}$ as control sequences 10 to drives 11, 12 of the crane 1. The velocity requests $V_{ref}$ are read and stored in the control system 9, after which each velocity request $V_{ref}$ is compared with the previous velocity request and, if the velocity request $V_{ref}$ is changed, an acceleration sequence (either with a plus or a minus sign) for a corresponding velocity change is formed and stored, after which, irrespective of whether the velocity request $V_{ref}$ changes, the velocity changes defined by the stored acceleration sequences at a particular time are summed and the obtained sum dV is added to the previous velocity request $V_{ref}$ to achieve a new velocity request $V_{ref2}$, which is set as a new control and velocity request $V_{ref2}$ for the crane drives. Some of the velocity changes defined by the summed acceleration sequences are performed at the definition time of each sequence and the rest of them are performed as delayed. The above-described method is described in greater detail in Finnish Patent 89155, and the details thereof, such as the summing of velocity or acceleration sequences known per se, are thus not described in more detail, but a reference is made, for instance, to the patent mentioned above.

In an application of the invention with a preferred implementation, a velocity target value $V_{ref}$ given by a driver is read with a control step of 5 ms and velocity requests in the memory are read in a time plane of 100 ms, i.e. 20 times slower than previously. Whenever the velocity target value $V_{ref}$ changes, a velocity sequence implementing the corresponding velocity change and preventing the load swinging is formed and the first part of it is performed. The other parts from the group of 20 program rounds are added together and stored as one part of the velocity sequence preventing the swinging in the table, the part corresponding to the velocity changes that took place during 20 program rounds, i.e. 100 milliseconds. Correspondingly, the tables are gone through once during 100 ms, i.e. twenty times 5 ms. In a preferred technical embodiment of the invention, control can be improved by dividing this velocity change, calculated at intervals of 100 ms in the example, by a control step of 5 ms according to the example by dividing it into 20 parts, each of which is added to the velocity request during the next twenty control steps of 5 ms.

Preferably the change of the velocity actual value is restricted so that with respect to the previous change, the change cannot be bigger than such a velocity change to be calculated with a used control step that does not exceed the set maximum value for acceleration or deceleration. In a technically preferred embodiment, these threshold values can be freely changed during the calculation process. Furthermore, said change of the velocity actual value can be restricted so that if the part of requests preventing the swinging, calculated on the basis of the tables and performed as delayed would exceed the predefined velocity change, the new control is adapted so that the control implemented with the control step does not exceed the set restrictions.

If the velocity request change calculated on the basis of the tables and to be performed as delayed would, either alone or performed together with the first part of the velocity sequence to be calculated on the basis of the velocity request of the driver, have a bigger velocity than the set maximum movement velocity, the new velocity sequence is amended in a technically preferred embodiment of the invention so that velocity will not be exceeded.

Furthermore, in a technically preferred embodiment of the invention, the magnitude of a new sequence can be changed during its formation, if the load of crane transmission drives has become so great that not enough power can be produced for performing the requested velocity change. The velocity request can thus be adapted and overload prevented, while, at the same time, maintaining the power of the control preventing the load swinging.

In a preferred embodiment of the invention, tables in which the delayed parts of the previous control sequences are stored are gone through in such a manner that, if the control step used is D and the longer processing interval of the stored sequences is n*D and the size of the tables L, some of the tables are gone through in some or all periods of a quick control step so that all L lines of the table are processed during a complete processing interval n*D. The size of the tables and n can vary.

The parts of the sequences to be performed as delayed can be stored in a two-element table, for instance, wherein a velocity change is defined in the first element and time, after which the velocity change or changes to be performed as delayed is/are added to the velocity request, is defined in the second element.

The time after which the changes are performed is expressed as a figure and defined in such a manner that $T_{SP}$, for instance, represents the complete oscillation period of the load 8. Whenever an element of the table is processed, a figure $T_{step}$, representing the past time, is obtained from the formula:

$$T_{step}=T_{step}+D/T*T_{SP},$$

where D=control step (sample interval), and

T=the above-described oscillation time of the load 8

When a new sequence is stored in the table, the part of the table representing the past time $T_{step}$ is set to zero. Whenever tables are gone through, a figure calculated with the above formula and describing the time which has passed during the sample interval D in respect of the complete oscillation time T of the load 8 is added to the line of the table describing past time $T_{step}$. When the value of the element reaches the figure which represents the part of the complete oscillation period $T_{SP}$ by which the stored velocity change is to be delayed, this velocity control is carried out and these elements of the table are set to zero.

If the stored sequence requires a plurality of delayed controls, the adjustment to zero occurs when the last part of the sequence has been performed. If a two-step control is used, a delayed velocity change is performed when the value of the element processing the past time reaches or exceeds the value $T_{SP}/2$.

Acceleration should be understood herein both as positive and negative, in other words as acceleration in its literal sense and as an opposite deceleration effect.

The above specification is only intended to illustrate the basic idea of the invention. Thus, a person skilled in the art can implement the invention in various alternative ways within the scope of the attached claims.

The invention claimed is:

1. A method for controlling a crane, comprising:

providing a plurality of velocity requests as control sequences from a crane control system to crane drives at first time intervals;

storing the velocity requests in the crane a control system;

comparing each of the plurality of velocity requests with a previous velocity request to determine a velocity change;

forming an acceleration sequence for each corresponding velocity change;

storing each acceleration sequence as a stored acceleration sequence;

summing the velocity changes defined by the stored acceleration sequences over a second time interval to form an obtained sum, the second time interval being several multiples of each of the first time intervals;

adding the obtained sum to the previous velocity request to achieve a new control for the crane drives; and performing some of the summed velocity changes immediately and performing the rest of the velocity changes at a delayed time over the second interval.

2. The method of controlling a crane according to claim 1, wherein the second time interval is 20 times each of the first time intervals.

3. The method of controlling a crane according to claim 1, wherein a ratio of the second time interval to each of the first time intervals is variable.

4. The method of controlling a crane according to claim 1, wherein the acceleration sequences are stored in a two part table, wherein the velocity change is stored in a the first of the two parts, and the delayed time delay is stored in a second of the two parts.

5. The method of controlling a crane according to claim 1, wherein each a velocity change is restricted in size so that the sum of the velocity change and the previous velocity request does not exceed a predetermined maximum acceleration.

* * * * *